US008279026B2

(12) United States Patent
Majumder et al.

(10) Patent No.: US 8,279,026 B2
(45) Date of Patent: Oct. 2, 2012

(54) MICRO-MACHINED RELAY

(75) Inventors: Sumit Majumder, Malden, MA (US); Kenneth Skrobis, Maynard, MA (US); Richard H. Morrison, Taunton, MA (US); Geoffrey Haigh, Boxford, MA (US)

(73) Assignee: Analog Devices, Inc., Norwood, MA (US)

( * ) Notice: Subject to any disclaimer, the term of this patent is extended or adjusted under 35 U.S.C. 154(b) by 86 days.

(21) Appl. No.: 12/562,390

(22) Filed: Sep. 18, 2009

(65) Prior Publication Data

US 2010/0012471 A1 Jan. 21, 2010

Related U.S. Application Data

(63) Continuation of application No. 11/339,997, filed on Jan. 26, 2006, now abandoned, which is a continuation-in-part of application No. 10/694,262, filed on Oct. 27, 2003, now Pat. No. 7,075,393.

(60) Provisional application No. 60/421,162, filed on Oct. 25, 2002, provisional application No. 60/647,215, filed on Jan. 26, 2005.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,674,180 | A | 6/1987 | Zavracky et al. | 29/622 |
| 4,959,515 | A | 9/1990 | Zavracky et al. | 200/181 |
| 5,258,591 | A | 11/1993 | Buck | 200/181 |
| 5,278,368 | A * | 1/1994 | Kasano et al. | 200/181 |
| 5,638,946 | A | 6/1997 | Zavracky | 200/181 |
| 6,094,116 | A | 7/2000 | Tai et al. | 335/78 |
| 6,153,839 | A | 11/2000 | Zavracky et al. | 200/181 |
| 6,160,230 | A * | 12/2000 | McMillan et al. | 200/181 |
| 6,307,452 | B1 | 10/2001 | Sun | 333/262 |
| 6,384,353 | B1 * | 5/2002 | Huang et al. | 200/181 |
| 6,433,657 | B1 * | 8/2002 | Chen | 200/181 |
| 6,531,668 | B1 | 3/2003 | Ma | 200/181 |
| 6,686,820 | B1 | 2/2004 | Ma et al. | 333/262 |
| 6,706,981 | B1 | 3/2004 | Ma et al. | 200/181 |
| 6,734,770 | B2 * | 5/2004 | Aigner et al. | 335/78 |
| 6,812,814 | B2 | 11/2004 | Ma et al. | 333/262 |

(Continued)

FOREIGN PATENT DOCUMENTS

| | | |
|---|---|---|
| EP | 0 924 730 A1 | 6/1999 |
| WO | WO 02/32806 A1 | 4/2002 |
| WO | WO 2004/038751 | 5/2004 |

*Primary Examiner* — Bernard Rojas

(74) *Attorney, Agent, or Firm* — Sunstein Kann Murphy & Timbers LLP

(57) ABSTRACT

An improved micro-machined relay is disclosed. The relay includes a micro-machined beam capable of carrying an electric signal and having a contact point on a closure side of the beam. The beam is electrically coupled to a first electrical transmission path and suspended above a second electrical transmission path. An insulation layer resides on a portion of the closure side of the beam and an electrical conductor is coupled to a least a portion of the insulation layer. A potential creator creates a potential between the electrical conductor and the potential creator that is capable of deflecting the beam, so that the contact point comes into contact with the second electrical transmission path. In such an embodiment, the potential creator need not account for the possible signal in the transmission path because the potential creator, which may be a voltage source, is decoupled from the transmission path.

13 Claims, 7 Drawing Sheets

Side View

U.S. PATENT DOCUMENTS

| | | | | |
|---|---|---|---|---|
| 6,872,902 | B2 | 3/2005 | Cohn et al. | 200/181 |
| 6,875,936 | B1 | 4/2005 | Suzuki et al. | 200/181 |
| 7,123,119 | B2 * | 10/2006 | Pashby et al. | 333/262 |
| 2002/0146919 | A1 | 10/2002 | Cohn | 439/66 |
| 2004/0140872 | A1 | 7/2004 | Wong | 335/78 |
| 2009/0127082 | A1 * | 5/2009 | Zhang et al. | 200/181 |

* cited by examiner

MICRO-MACHINED RELAY

PRIORITY

The present application claims priority from the following listed applications and is a continuation of U.S. patent application Ser. No. 11/339,997 filed on Jan. 26, 2006 entitled "Micro-Machined Relay," which is itself a continuation-in-part of U.S. patent application Ser. No. 10/694,262 filed on Oct. 27, 2003 entitled "A micromachined Relay with Inorganic Insulation," now issued as U.S. Pat. No. 7,075,393 on Jul. 11, 2006, which itself claims priority from U.S. Provisional Patent Application Ser. No. 60/421,162 filed on Oct. 25, 2002. U.S. patent application Ser. No. 11/339,997 also claims priority from U.S. Provisional Patent Application Ser. No. 60/647,215 filed on Jan. 26, 2005, entitled "Improved Micro-machined Switch and Relay." All of the foregoing patent applications are incorporated herein by reference in their entirety.

TECHNICAL FIELD AND BACKGROUND ART

The present invention relates to micro-machined relays, and more specifically to micro-machined relays that separate the gate voltage from the source voltage.

Relays are used in circuit design to provide a true switch having two states: completely-on and completely-off. This type of switch is in direct opposition to MOS based switches that have a voltage region in which the switch is partially on or partially off. Relays provide the benefit of a low-on resistance and a high-off resistance, whereas MOS based switches leak current and have a high-on resistance.

A micro-machined relay includes a source, drain, a conductive beam structure, and a gate. The micro-machined relay closes when a potential between the beam structure and the gate creates an electrostatic force that bends the beam so that the source and drain are electrically connected. In prior art micro-machined relays, the closure voltage was tied to the signal voltage. For example, if 30V were required to make a firm closure of the micro-machined relay, so that the signal can pass between the source and the gate and the signal voltage is + or −2V, the voltage applied to close the switch must be at least 32V. As signal voltages increase, for example to + or −15V, then the switch must be able to supply a voltage of 45V and can see a maximum voltage of 60V. In a micro-machined relay structure, this amount of voltage can break the beam of the relay.

SUMMARY OF THE INVENTION

In a first embodiment of the invention there is provided an improved micro-machined relay. The relay includes a micro-machined beam capable of carrying an electric signal and having a contact point on a closure side of the beam. The beam is cantilevered, electrically coupled to a first electrical transmission path, and suspended above a second electrical transmission path. An insulation layer resides on a portion of the closure side of the beam and an electrical conductor is coupled to a least a portion of the insulation layer. An actuation potential, such as a switchable current source, creates a potential between the electrical conductor and the actuation potential that is capable of deflecting the beam, so that the contact point comes into contact with the second electrical transmission path. In such an embodiment, the actuation potential need not account for the possible signal in the transmission path, because the actuation potential is decoupled from the transmission path.

In another embodiment, the micro-machined relay includes an electrically conductive cantilevered deflectable beam suspended in part over the substrate. A layer of insulation is placed on at least a portion of the side of the deflectable beam that is proximate to the substrate. An electrically conductive layer resides on at least a portion of the layer of insulation. Below a portion of the deflectable beam not having the conductive layer is positioned a gate on the substrate. The micro-machined relay includes a first electrically conductive signal path on the substrate wherein part of the electrically conductive signal path includes a signal contact point positioned below a portion of the deflectable beam having both the layer of insulation and the electrically conductive layer. The electrically conductive layer may be formed in the shape of a finger. In this embodiment, the electrically conductive layer on a portion of the layer of insulation of the deflectable beam is coupled to a second signal path on the substrate. Thus, the second signal path begins on or within the substrate and runs along the side of the beam that is coupled to the substrate and along a portion of the underside of the beam. This second signal path is separated from the electrically conductive beam by the layer of insulation.

In certain other embodiments, an electrically conductive signal path has a gap below a portion of the deflectable beam. When the beam is deflected by a voltage produced by an actuation potential, such as a switchable voltage source, an electrically conductive layer on a portion of the layer of insulation closes the gap and allows for an electrical signal to be transmitted across the gap. In certain embodiments, the deflective beam is electrically conductive. The deflective beam can be coupled to a potential, for example ground. A potential difference between the potential and voltage of actuation potential coupled to the gate contact is equal to or greater than a potential difference for deflecting the deflectable beam. As a result, the electrically conductive layer contacts the conductive signal path on the substrate.

In yet another embodiment, the deflectable beam is electrically conductive and includes a layer of insulation suspended above the gate. In other embodiments, there is no insulation layer between the suspended electrically conductive beam and the gate. In certain embodiments, the gate is centrally position along the length of the beam. In other embodiments, the gate is positioned near the free end of the cantilevered beam as opposed to the attached end that is coupled to the substrate.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1:
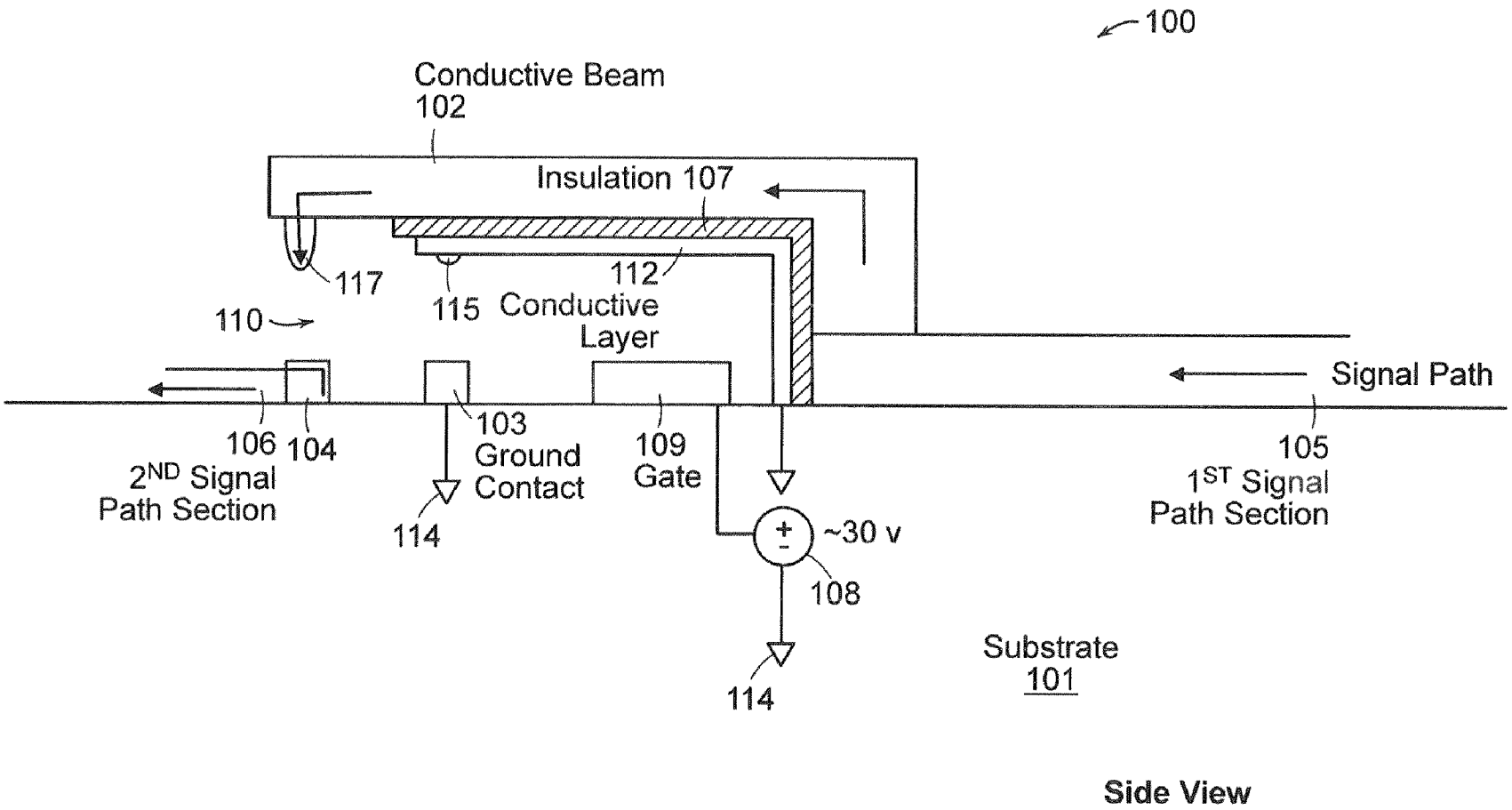
FIG. 1 is a side view of a first embodiment of a micro-machined relay wherein the signal path is through the conductive beam.
Figure 1A:
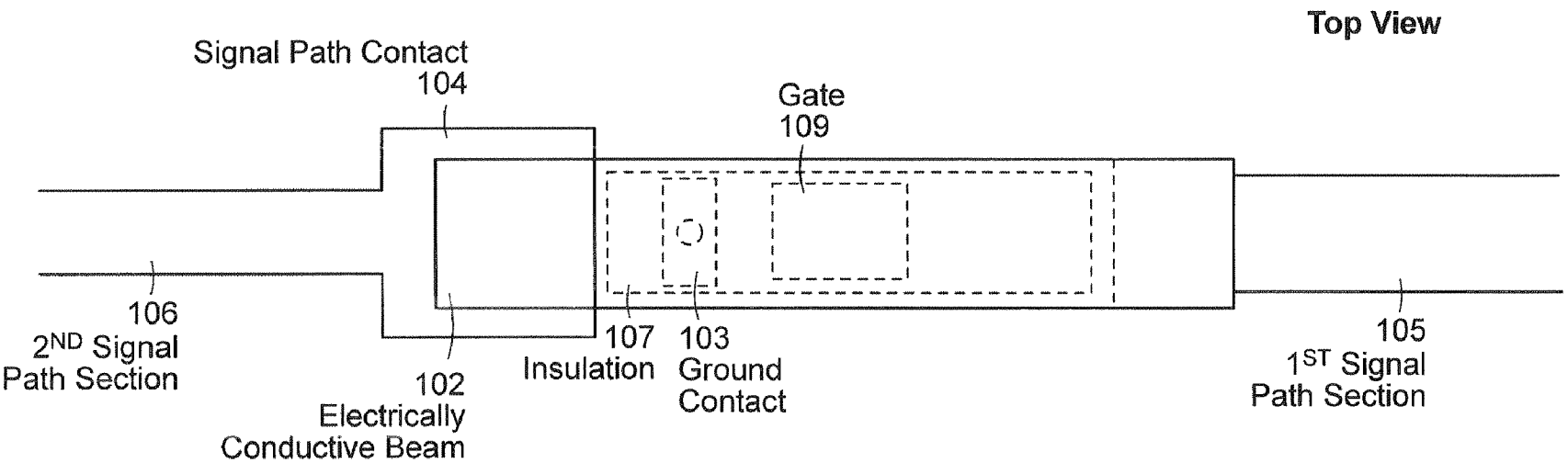
FIG. 1A is a top view of the embodiment shown in FIG. 1

FIG. 1 shows a side view and FIG. 1A shows a top view of a first embodiment of a micro-machined relay 100. The relay includes a substrate 101, a cantilevered beam 102 suspended at a first end above the substrate 101, a gate 109 and a signal path contact point 104. The beam 102 of the relay deflects in response to a voltage differential between a conductive layer 112 on the beam 102 and the gate 109 and thereby closes an open circuit allowing current to flow. The substrate 101 of the relay may be composed of a substance, such as silicon or silicon oxide. In this embodiment, the beam structure 102 carries the electrical signal and the beam structure is part of the signal path 105, 106. As such, the beam structure 102 is composed of an electrically conductive substance. On the underside of the beam structure is an insulation layer 107. On the insulation layer 107 is the conductive layer 112. The conductive layer may be for example, metal or a conductive polymer. Similarly, the beam structure can be constructed from metal or a conductive polymer. The insulation layer 107 can be a dielectric or a material having a high dielectric constant. The insulation layer 107 isolates the electrical signal transmitted through the beam 102 from the potential produced by an actuation potential 108 coupled to the gate 109 that is used for closing the relay.

Additionally, as shown, a ground contact 103 is positioned on the substrate 101 opposite the underside 110 of the beam. The ground contact 103 is provided for high frequency operation of the relay. By including the ground contact 103 which when the beam deflects is electrically coupled through the conductive layer 112 to ground 114, the conductive layer 112 operates as a transmission line. This transmission line provides the same attributes as a micro-strip transmission line during high-frequency operation.

The relay 100 operates in the following manner: the actuation potential 108 is coupled to the gate 109 and the conductive layer 112 is coupled to a ground potential 114. When the actuation potential 108 switches on and a potential is introduced between the gate 109 and the conductive layer 112, an electrostatic field is created causing the beam 102 to bend so that the conductive layer 112 and the ground contact 103 come into firm contact. As shown, the conductive layer 112 may include an extended conductive section 115, such as a finger, for making contact with the ground contact 103. A typical voltage for causing the gate to close is on the order of 30V. Additionally, the beam 102 comes into contact with the signal path contact 104, and therefore, current can flow and the signal can travel between the first signal path section 105 and the second signal path section 106. As with the conductive layer 112, the beam 102 may include an extended conductive finger 117 that is positioned above the signal path contact point. Not shown in the figure are isolation layers that are formed in the substrate 101. The actuation potential 108 is isolated from the signal path 105, 106 so that the actuation potential 108 does not interfere with the signal on the signal path.

In the present embodiment, the conductive layer 112 is coupled to a zero potential (ground). In other embodiments, the conductive layer 112 may be set at another potential. A voltage source (not shown), could be coupled to the substrate and to the conductive layer and isolated from the actuation potential. A voltage differential between the gate 109 and the conductive layer 112 would be set, such that when the actuation potential is switched on, the beam 102 would bend making contact with the second signal path section 104, 106. In yet another embodiment, the conductive layer 112 could be electrically coupled to the actuation potential 108. In such an embodiment, the gate 109 would be electrically coupled to ground or another potential such that the difference between the actuation potential and the potential coupled to the gate is capable of closing the relay.

Figure 2:
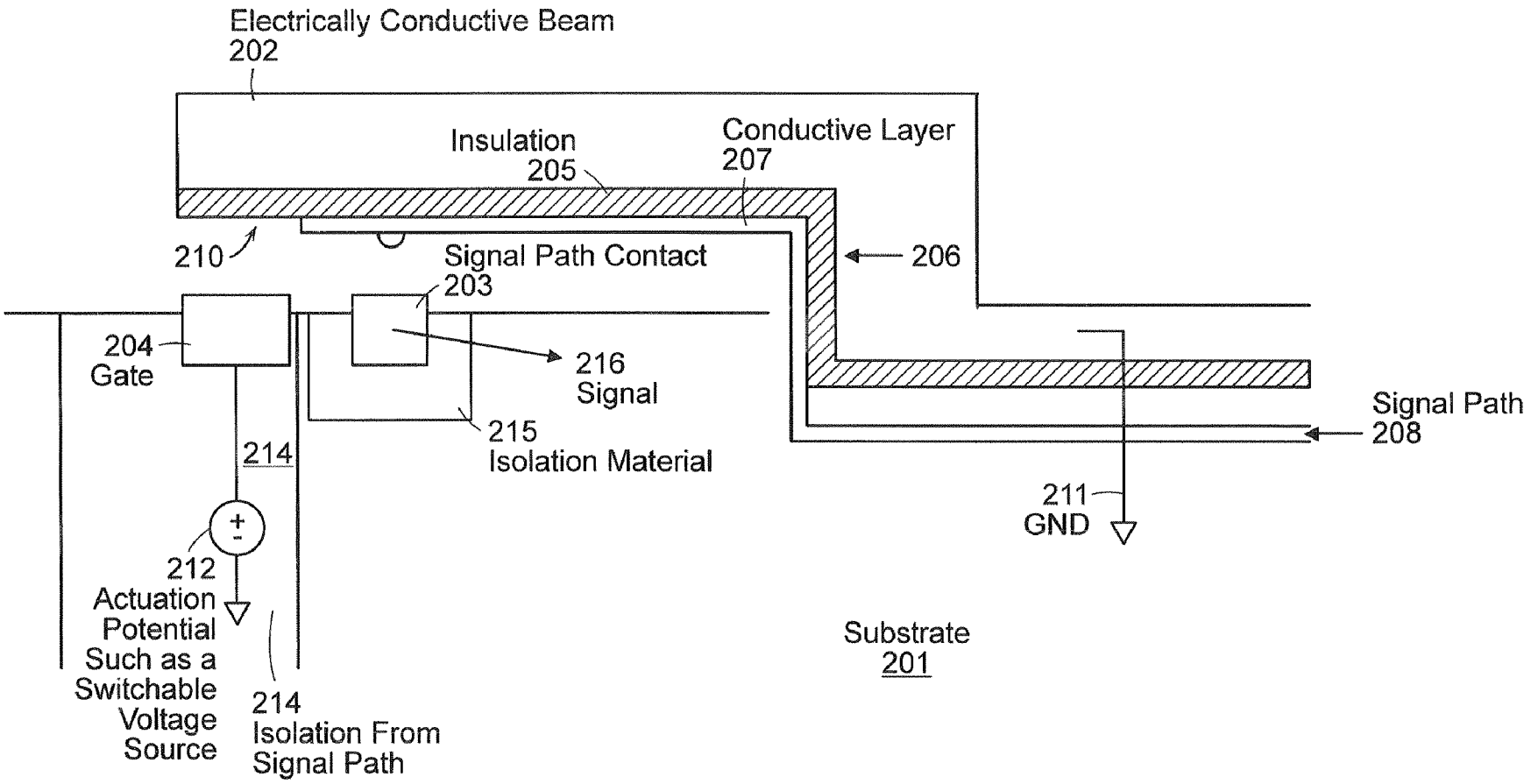
FIG. 2 is a side view of a second embodiment of a micro-machined relay wherein the signal path is on an electrically conductive layer insulated from the electrically conductive beam.

FIG. 2 shows another embodiment of a micro-machined relay. The relay includes a substrate 201, a cantilevered bendable electrically conductive beam 202, a signal path contact 203 and a gate 204. An inorganic insulation material 205 resides on the underside of the beam and runs down a side surface 206 of the beam. The insulation 205 separates the gate voltage from the beam voltage. Applied to the insulation layer 205 is a conductive layer 207. The conductive layer 207 carries the voltage signal and is part of the signal path 208. As shown in FIG. 2, the conductive layer 207 resides on the insulation layer 205 on both the underside 210 of the beam and along the side of the beam 206. Additionally, the conductive layer 207 continues either on or within the substrate 201. The electrically conductive beam 202 is tied to ground 211 in the Fig. The gate 204 is coupled to a switchable voltage supply 212 or another actuation potential that is electrically isolated from the gate voltage. As shown in the figure, an insulation layer(s) 214, 215 isolates the gate from the switchable voltage source 212, so the voltage signal is not altered by the voltage of the switchable voltage source 212. Other techniques known by those of ordinary skill in the art for isolating signals may be employed. When the switchable voltage source 212 is switched on, a potential voltage is generated between the gate 204 and the electrically conductive beam 202. The voltage differential is preferably great enough to bend the beam so that the signal path contact 203 contacts the conductive layer 207 allowing the voltage signal to pass along the second signal path 216. As shown in the figure, the second signal path 216 is represented by an arrow that is coming out of the page. Thus, the figure represents the three dimensional nature of the embodiment.

It should be understood by those of ordinary skill in the art that the switchable voltage source could be tied to the electrically conductive beam and the gate could be coupled to ground or another voltage potential such that the differential would cause the electrically conductive beam to bend closing the relay when the switchable voltage source is switched on.

Figure 3:
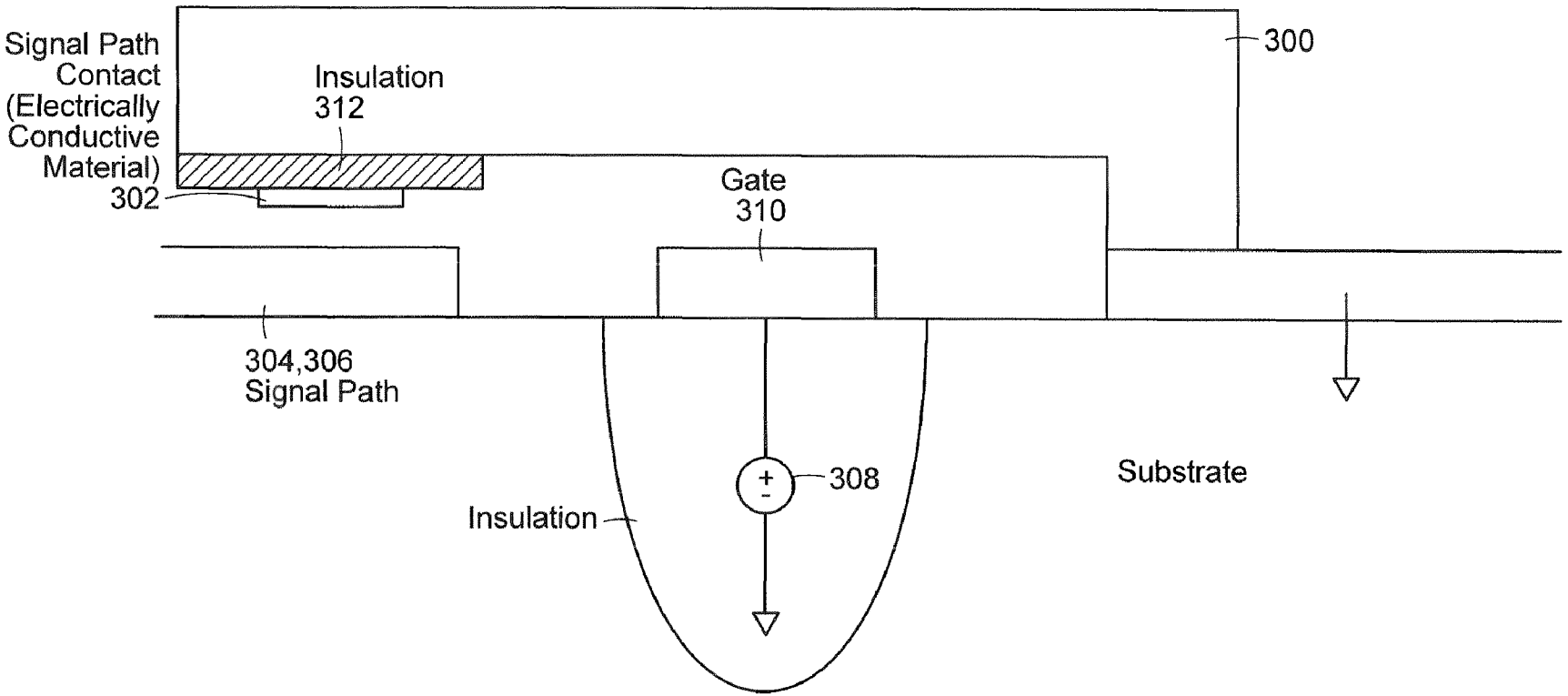
FIG. 3 is side view of a third embodiment of a micro-machined relay wherein when the beam bends an electrically conductive layer closes a gap between a first and a second signal path.
Figure 3A:
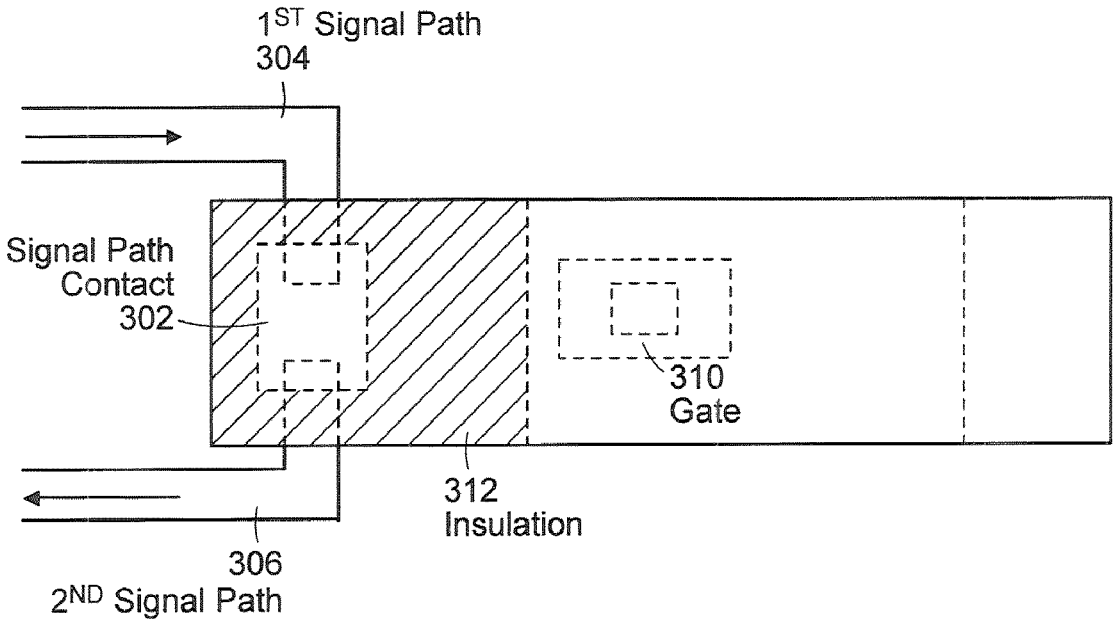
FIG. 3A is a top view of the embodiment of FIG. 3.

In the micro machined relay embodiment of FIG. 3 (Side View) and FIG. 3A (Top View), the voltage signal is not transmitted along the beam 300, but rather an electrically conductive layer 302 attached to the beam completes a gap between a first and a second signal paths 304,306. This embodiment is similar to that shown in parent application Ser. No. 10/694,262 where there are a first and a second signal path 304, 306 separated by a gap. When the switchable voltage supply 308 is switched and the voltage is applied to the gate 310 and the beam 300 bends due to the electrical potential between the beam 300 and the gate 310, the electrically conductive material 302 on the insulating layer 312 bridges the gap and closes the open circuit, allowing current to flow and the voltage signal to move between the first and second signal paths 304,306.

Figure 4:
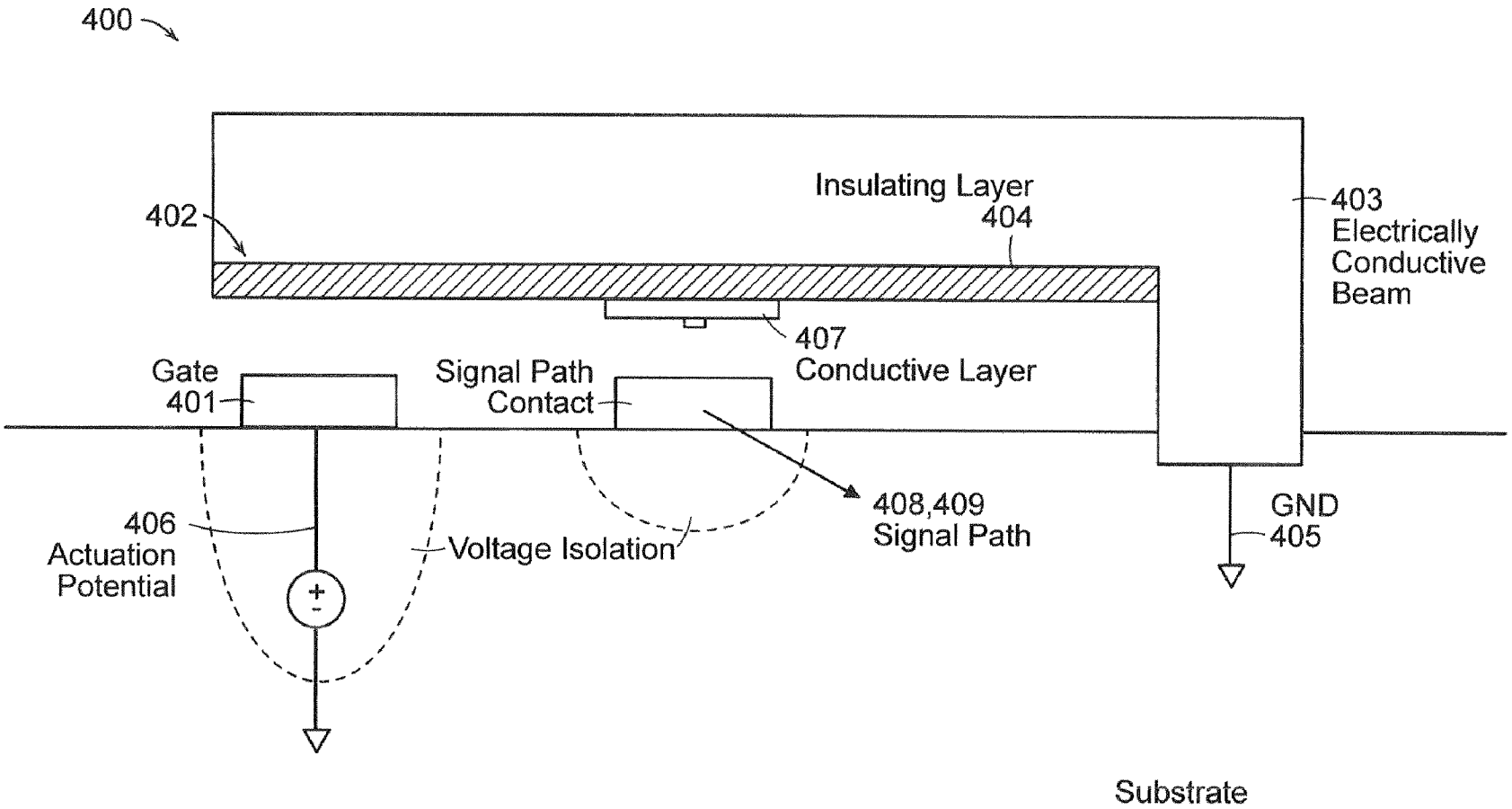
FIG. 4 is a side view of a fourth embodiment of a micro-machined relay wherein the gate contact is positioned below the suspended end of the electrically conductive beam and the electrically conductive layer is located centrally on the beam.
Figure 4A:
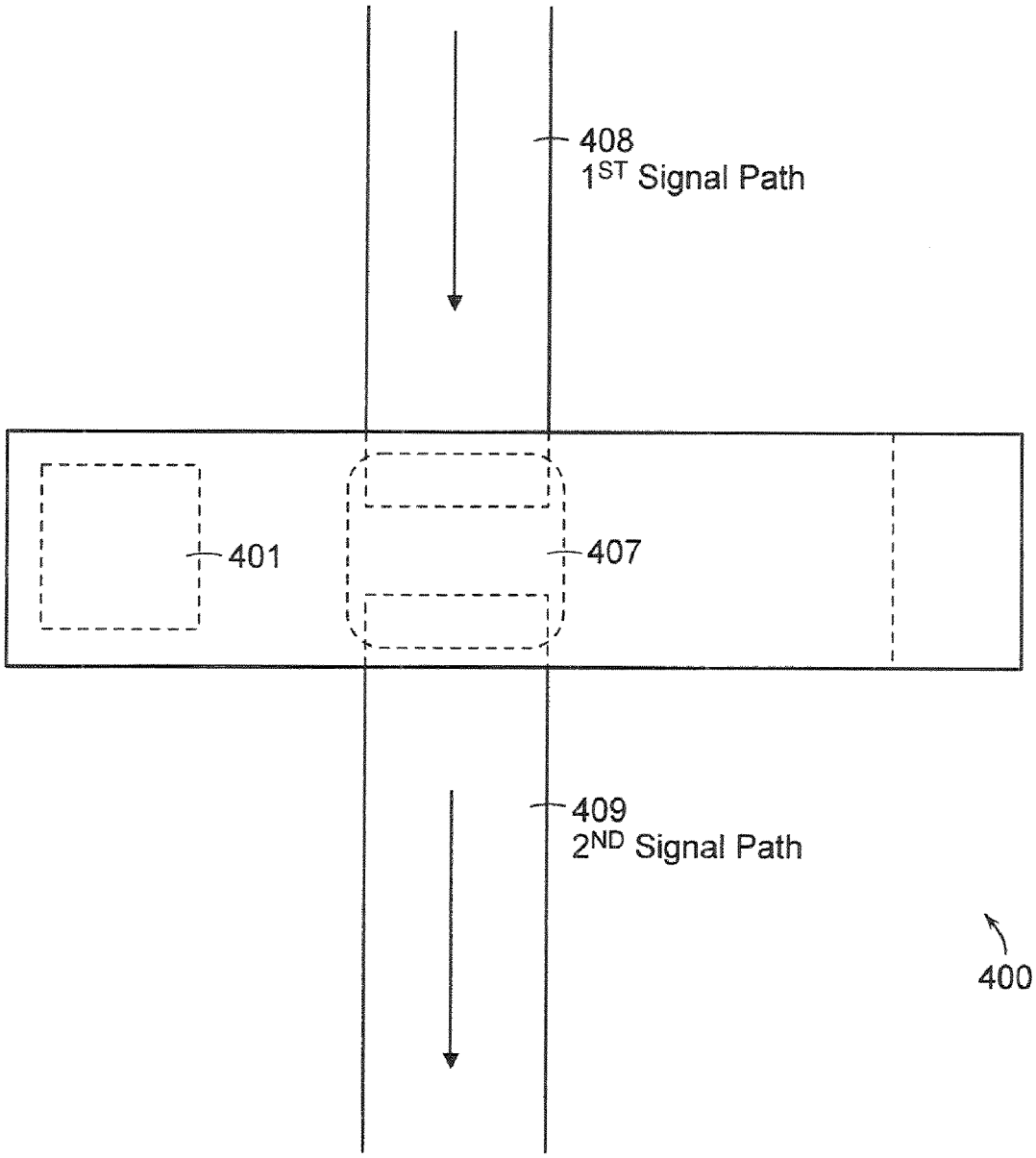
FIG. 4A is a top view of the embodiment shown in FIG. 4.

FIGS. 4 (Side View) and 4A (Top View) show another embodiment of a micro-machined relay 400. In this embodiment as compared to the embodiment in FIG. 3, the gate 401 is located underneath the cantilevered end 302 of the beam 403, rather than underneath the center of the beam 403. Thus, the potential between the gate 401 and the electrically conductive beam 403 can be less due to the greater lever arm. An insulating layer 404, such as polyimide, is formed on the underside of the beam structure 403. It should be understood by one of ordinary skill in the art that any of the embodiments described in this application can be made using conventional production techniques including photolithography, vapor-deposition, dry-etching techniques, and sacrificial layers. The beam 403 is coupled to a potential source 405, such as ground and the gate contact 401 is coupled to a potential actuator, such as a switchable voltage source 406. As before, the voltage differential between the gate 401 and the beam 403 must be greater than the voltage necessary to bend the beam so that a portion of the insulation layer 404 comes into contact with the gate contact 401. The bending of the beam 403 also causes the conductive layer 407 to contact both the first and second signal paths 408,409 closing the open circuit and allowing current to flow between the first and second signal paths 408,409. It should be clear that the gate and the electrically conductive beam 403 (or the conductive layer in the embodiment shown in FIG. 1) must be at different potentials such that the potential difference causes the beam to bend allowing current to flow through the signal path. Thus, for example if the required differential is 30V (the closure voltage is dependent on the size, shape, material and lever arm of the beam), the beam and the gate could be at any number of different combinations of voltage levels.

Although various exemplary embodiments of the invention have been disclosed, it should be apparent to those skilled in the art that various changes and modifications can be made that will achieve some of the advantages of the invention without departing from the true scope of the invention. These and other obvious modifications are intended to be covered by the appended claims.

What is claimed is:

1. A micro-machined relay comprising:

a substrate;

a deflectable beam having a first surface and a second surface, the deflectable beam suspended in part over the substrate;

a layer of insulation on at least a portion of the second side of the deflectable beam;

an electrically conductive layer on at least a portion of the layer of insulation;

a gate positioned below a portion of the second side of the deflectable beam not having the conductive layer; and an electrically conductive signal path on the substrate wherein part of the electrically conductive signal path includes a signal contact positioned below a portion of the second side of the deflectable beam having both the layer of insulation and the electrically conductive layer;

wherein the electrically conductive layer on a portion of the layer of insulation of the deflectable beam is coupled to a second signal path on the substrate when the relay is open.

2. The micro-machined relay according to claim 1, wherein the deflectable beam is electrically conductive.

3. The micro-machined relay according to claim 2, wherein the deflectable beam is coupled to a potential, wherein a potential difference between the potential and voltage of an actuation potential coupled to the gate is equal to or greater than a potential difference for deflecting the deflectable beam so that the electrically conductive signal path on the surface electrically contacts the electrically conductive layer.

4. The micro-machined relay according to claim 1, wherein the gate is coupled to a switchable voltage source.

5. The micro-machined relay according to claim 1, wherein the deflectable beam is coupled to a switchable voltage source.

6. A micro-machined relay comprising:

a substrate;

a cantilevered deflectable beam having a first surface and a second surface, the deflectable beam suspended in part over the substrate;

a layer of insulation on a portion of the second side of the deflectable beam;

an electrically conductive layer on a portion of the layer of insulation, such that the layer of insulation is disposed between the electrically conductive layer and the deflectable beam;

a gate positioned below the second side of the deflectable beam;

a first electrical signal path on the substrate;

a second electrical signal path on the substrate;

wherein when the deflectable beam is deflected, the deflectable beam electrically connects the first electrical signal path and the second electrical signal path via the electrically conductive layer.

7. The micro-machined relay according to claim 6, wherein the deflectable beam is coupled to an electric potential, such that when a switchable voltage source coupled to the gate is switched a potential is created between the electric potential of the deflectable beam and an actuation potential to cause the deflectable beam to deflect.

8. The micro-machined relay according to claim 6, wherein the gate is coupled to a switchable voltage source.

9. The micro-machined relay according to claim 6, wherein the deflectable beam is coupled to a switchable voltage source.

10. A micro-machined relay comprising:

a substrate;

an electrically conductive deflectable beam configured to carry an electric signal, the electrically conductive deflective beam having a first side and a second side and suspended in part over the substrate;

a layer of insulation at least on a portion of the second side of the deflectable beam;

an electrically conductive layer on at least a portion of the layer of insulation;

a gate positioned below a portion of the second side of the deflectable beam having the electrically conductive layer;

a first contact on the substrate and positioned below a portion of the electrically conductive layer;

wherein the deflectable beam, the layer of insulation, the electrically conductive layer and the first contact are configured such that, when the deflectable beam is deflected, a portion of the electrically conductive layer makes electrical contact with the first contact, so as to create a first electrically conductive path, insulated from the conductive deflectable beam by the layer of insulation, and extending from the first contact, along the conductive layer, to a node in the substrate; and an electrically conductive signal path on the substrate wherein part of the electrically conductive signal path includes a signal contact positioned directly below a portion of the second side of the deflectable beam having neither the layer of insulation nor the electrically conductive layer.

11. The micro-machined relay according to claim 10, further comprising:

a switchable voltage source electrically coupled to the gate.

12. The micro-machined relay according to claim 10, further comprising:

a switchable voltage source electrically coupled to the deflectable beam.

13. The micro-machined relay according to claim 10, wherein the first conductive path forms at least part of a transmission line.

* * * * *